United States Patent [19]

Schiron et al.

[11] 4,079,930

[45] Mar. 21, 1978

[54] SWIMMING POOL DIVING TOWER

[76] Inventors: Klaus Schiron, Nelkenstrasse 2, 3100 Celle; Hans Friedrich Rupprath, Am Goldener Acker 35, 3001 Bennigsen, both of Germany

[21] Appl. No.: 717,149

[22] Filed: Aug. 24, 1976

[30] Foreign Application Priority Data

Sep. 2, 1975 Germany ..... 2539004

[51] Int. Cl.[2] ..... A63B 5/10

[52] U.S. Cl. ..... 272/66

[58] Field of Search ..... 272/66, 65, 109; 254/93; 52/292, 29; 4/172; 182/141; 187/17

[56] References Cited

U.S. PATENT DOCUMENTS 2,212,460 8/1940 Stephenson ..... 272/66

3,902,718 9/1975 Avon ..... 272/66

*Primary Examiner*—Harland S. Skogquist
*Assistant Examiner*—William R. Browne
*Attorney, Agent, or Firm*—Beall & Jeffery

[57] ABSTRACT

A height adjustable swimming pool diving tower comprising a well-like foundation, a diving board, a central support column partially accommodated and guided in the foundation shaft and carrying the dive board, and a hydraulic stroke device for lifting or lowering the column together with the dive board and arranged on the bottom of the foundation shaft and in a recess in the central column, the foundation, column, and diving board consisting of concrete or reinforced concrete and the guiding being performed by means of a number of guides situated in the foundation walls in at least two planes above one another.

9 Claims, 2 Drawing Figures

SWIMMING POOL DIVING TOWER

BACKGROUND OF THE INVENTION

1. Field of Invention

The invention relates to a swimming pool diving tower the height of which may be adjusted by means of hydraulic lifting device and which has a well-like foundation, anchorage or the like and a diving board which may be moved by the lifting device, of the type in which the lifting device is situated in the foundation.

2. Description of Prior Art

Hydraulically height adjustable diving towers are known in which a platform comprising a steel frame construction having a decking may be raised by means of two or three hydraulic lifting cylinders and may be secured at the desired height, also by means of the cylinders. Due to their light construction using open profiles such diving towers are not sufficiently rigid for diving and tend to vibrate. These characteristics have made it necessary to progress from constructions having only one cylinder to constructions of the mentioned type having two or even three cylinders, which by their nature are technically complex and expensive. Steel structures also do not fit in well architectually with the usual concrete design and construction employed in swimming pools.

OBJECT OF INVENTION

It is the main object of the invention to improve hydraulic diving towers whose height may be altered and to remove their present shortcomings so that they are completely rigid and stable and do not spoil the uniformity of design of the swimming pool.

SUMMARY OF THE INVENTION

This object is achieved in accordance with the invention in that the lifting device is arranged in a recess in a central support column the upper end of which is secured to the diving board, that the foundation, column and diving board are formed of concrete or reinforced concrete, and that the column is guided in the well-like foundation by means of a number of guides situated in at least two planes above one another. It is thus possible to reliably guide the diving tower, and to retain it rigidly at any height and not subject to vibration. The choice of material ensures not only a high moment of inertia which contributes to a high stability and resonant frequency, but also that the swimming pool presents a uniform appearance without visible differences of building material. The resistance to corrosion in comparison with that of the known adjustable steel diving towers is also substantially improved.

In accordance with a preferred construction the foundation, column and the diving board connected to the column, are prefabricated components made of concrete or reinforced concrete.

This enables the diving tower to be economically manufactured and easily transported.

In accordance with a further preferred embodiment of the invention the recess in the support column is displaced towards the forward edge of the diving board which permits the diving board to be supported near its forward edge at which vibration is initiated.

In another advantageous construction the force of the lifting device is transmitted directly to, or adjacent the diving board. Thus the system comprising diving board and column is supported far above its centre of gravity which produces particularly favourable stability properties.

To ensure that the column is guided free from play, even over extended and continuous periods of operation, and to maintain the freedom from vibration for as long as desired the guides preferably comprise elements formed of extruded, sintered or anionically moulded plastics material which are prestressedly inserted and retained between the foundation and the column. The foundation is provided with recesses to accomodate the guides which achieves the desired prestress in the guides between the support column and the foundation.

BRIEF DESCRIPTION OF THE DRAWINGS

Other and further objects of the present invention will be apparent from the following description and claims and are illustrated in the accompanying drawings which by way of illustration show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

An embodiment of the invention will now be described in more detail with reference to the accompanying drawing in which:-

DESCRIPTION OF THE PREFERRED EMBODIMENT

Figure 1:
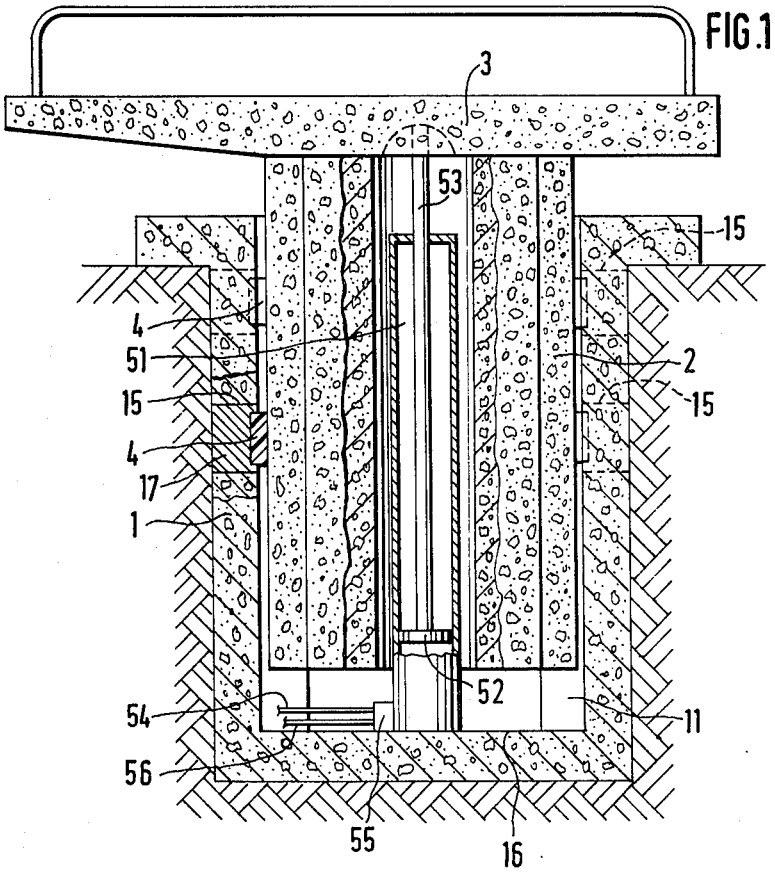
FIG. 1 is a sectional elevation of a diving platform in accordance with the invention.
Figure 2:
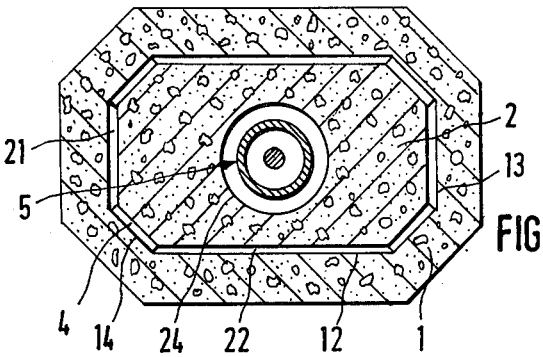
FIG. 2 is a horizontal section through the diving platform taken between the planes of the guides.

A well-like anchorage or foundation 1 of concrete or reinforced concrete comprises a shaft 11 extending vertically downwards into the earth and bounded by the opposing pairs of longitudinal walls 12, transverse walls 13 and corner walls 14 and is closed at the bottom by a floor 16. The corner walls 14 have formed in them two recesses 15 situated one over the other in which adjustable inserts 17 are secured. Due to the difference in length of the longitudinal walls 12 and the transverse walls 13 the shaft 11 has an elongate octagonal cross section.

The shape of the outer cross section of a diving tower column 2, also of concrete or reinforced concrete, corresponds to that of the shaft 11, and the space between each wall of the shaft 11 and that of the column 2 inside it is substantially the same. Each of the spaces at the corner walls 14 of the shaft 11 are filled by guides 4. The guides 4 comprise moulded pieces of plastics material (blocks or rollers), or semifinished articles of extruded, sintered or anionically moulded plastics material, preferably of the type of high molecular weight polyethylene, polyamide or polyterephthalate. The guides are set into inserts 17 mounted in the recesses 15 in the corner walls 14, and are prestressed in compression when the column 2 is inserted. A recess 24 in the interior of the column 2 affords space for the accommodation of a lifting device 5 which may comprise, for example a simply operating hydraulic cylinder 51 within which a piston 52 having a piston rod 53 is guided. Whilst the cylinder 51 is supported by, or secured to the bottom 16 of the foundation 1, the upper end of the piston rod 53 engages a recess in a diving board 3, which is also formed of concrete or reinforced concrete. A control valve 55 is arranged at the lower end of the cylinder 51 to actuate the latter so as to raise or lower the diving board 3. The valve 55 is provided with a remote control and controls the admission of fluid from a pressure line 54 and the discharge of fluid into an outlet line 56.

Thus an extremely stable bell-shaped configuration of the system comprising the support column and the diving board may be conveniently achieved which has very similar external architectural appearance to the usual rigid concrete diving towers since the lifting device consisting of steel is housed inside the structure.

The hydraulic drive produces sufficient power to force the tower up through the guides. The guides may be clamping guides and therefore not need to be offloaded or additionally controlled.

What is claimed is:

1. A swimming pool diving tower the height of which may be adjusted, comprising: awell-like foundation; a central column telescopically mounted within said well-like foundation and having a downwardly opening recess; a diving board secured to the upper end of said central column; a hydraulic lifting means mounted within said recess and well-like foundation for lifting said diving board and central column to adjust the height thereof; the foundation, central column and diving board being formed of concrete; and means guiding said central column in said well-like foundation by a plurality of guide bearings situated in at least two places above one another.

2. Diving tower according to claim 1 wherein the foundation, the column and the diving board connected to the column are prefabricated components made of concrete.

3. Diving tower according to claim 1 wherein the recess in the column is displaced towards the forward edge of the diving board.

4. Diving tower according to claim 1 wherein the guides comprise elements formed of extruded, sintered or anionically moulded plastics material which are prestressedly inserted and retained between the foundation and the column.

5. Diving tower according to claim 1 wherein the foundation is provided with recesses to accommodate the guides.

6. A diving tower according to claim 5, wherein the force of the lifting device acts along the central axis of said central column and is transmitted directly to a point at least closely adjacent the diving board aligned with the gravitational center of said diving board.

7. A diving tower according to claim 1, wherein said central column is polygonal in cross-section and said well-like foundation has a correspondingly polygonal shaped well telescopically receiving therein said central column.

8. A diving tower according to claim 1, wherein said diving board has a recess opening downwardly into said recess of said central column, and said hydraulic lifting means having an uppermost end secured within the uppermost portion of said recess.

9. A diving tower according to claim 8, wherein said hydraulic lifting means includes a single piston-cylinder having the lowermost end of the cylinder centrally disposed into the bottom of said well-like foundation and the uppermost end of said piston-rod extending within said downwardly opening recess of said diving board.

* * * * *